US007468010B2

(12) United States Patent
Du Brock

(10) Patent No.: US 7,468,010 B2
(45) Date of Patent: Dec. 23, 2008

(54) APPARATUS AND METHOD FOR TRAINING A BASEBALL PLAYER TO HIT A BASEBALL

(76) Inventor: Douglas Du Brock, 6119 Byron St., Rosemont, IL (US) 60018

( * ) Notice: Subject to any disclaimer, the term of this patent is extended or adjusted under 35 U.S.C. 154(b) by 381 days.

(21) Appl. No.: 11/402,474

(22) Filed: Apr. 12, 2006

(65) Prior Publication Data

US 2007/0243955 A1 Oct. 18, 2007

(51) Int. Cl.
*A63B 69/00* (2006.01)

(52) U.S. Cl. ..... 473/452

(58) Field of Classification Search ..... 473/424, 473/452, 415, 458, 234; 223/78; D12/217; 455/518

See application file for complete search history.

(56) References Cited

U.S. PATENT DOCUMENTS

| | | | | |
|---|---|---|---|---|
| 1,517,555 | A | 12/1924 | Graham | |
| 3,342,487 | A | 9/1967 | David | |
| 3,363,903 | A | 1/1968 | O'Brien | |
| 3,811,536 | A * | 5/1974 | Haynes | 188/32 |
| 3,815,906 | A | 6/1974 | Hermo | |
| 3,979,116 | A | 9/1976 | Matchick | |
| 4,194,735 | A | 3/1980 | Wilson | |
| 4,225,133 | A | 9/1980 | Kiray | |
| 4,322,084 | A | 3/1982 | Reece et al. | |
| 4,516,772 | A | 5/1985 | Stratton | |
| 4,932,656 | A | 6/1990 | Pierce | |
| 5,000,457 | A | 3/1991 | Brown | |
| 5,037,094 | A | 8/1991 | Johnson | |
| 5,083,789 | A | 1/1992 | Hickson | |
| 5,263,863 | A | 11/1993 | Stefani et al. | |
| 5,328,186 | A | 7/1994 | Hanson et al. | |
| 5,330,176 | A | 7/1994 | Cagney, Jr. | |
| 5,385,343 | A | 1/1995 | Davis, Sr. | |
| 5,613,677 | A | 3/1997 | Walker, Jr. | |
| 5,616,085 | A | 4/1997 | LaCoste, Jr. et al. | |
| 5,913,389 | A * | 6/1999 | Clark | 188/32 |
| 6,077,168 | A | 6/2000 | Huang | |
| 6,106,408 | A | 8/2000 | Roman | |
| 6,142,883 | A | 11/2000 | Ferrara | |
| 6,575,844 | B1 | 6/2003 | Gray | |
| 6,669,575 | B1 | 12/2003 | Marlette | |
| 6,926,625 | B1 * | 8/2005 | Fruechting | 473/452 |

(Continued)

*Primary Examiner*—Gene Kim
*Assistant Examiner*—M Chambers
(74) *Attorney, Agent, or Firm*—Neal, Gerber & Eisenberg LLP

(57) ABSTRACT

An apparatus for training a batter to hit a baseball with proper swing mechanics by controlling swing stride through tactile and proprioceptive feedback. The apparatus includes a base positionable on a ground surface adjacent to a hitting area and posterior to the batter standing on the ground surface. A stride limiter is adjustably attached to the base and transversely extends toward the hitting area adjacent a leading foot of the batter. The base and the stride limiter define a stride boundary for the batter during a swing, such that a negative feedback is provided to the batter during the swing if the batter's leading foot exceeds the stride boundary and contacts the apparatus and a positive feedback is provided to the batter during the swing if the batter's leading foot stays within the stride boundary and does not contact the apparatus. The apparatus may be configured with two stride limiters such that it can be positioned on either side of the hitting area to accommodate both right and left handed batters.

18 Claims, 4 Drawing Sheets

U.S. PATENT DOCUMENTS

2005/0143200 A1 6/2005 Hedgepath
2006/0030435 A1 2/2006 Opdyke
2006/0234816 A1* 10/2006 Reason-Kerkhoff ..... 473/452
2007/0243955 A1* 10/2007 Du Brock ..... 473/452

* cited by examiner

APPARATUS AND METHOD FOR TRAINING A BASEBALL PLAYER TO HIT A BASEBALL

TECHNICAL FIELD

The present invention generally relates to training devices for training baseball players, and more particularly to a device for training a batter to hit a baseball with proper swing mechanics by controlling swing stride through tactile and proprioceptive feedback.

BACKGROUND

The task of hitting a baseball requires multiple skills, including tempo, timing, muscle control, hand-eye coordination, as well as proper posture, position, set-up, stride control, and various mental aspects, such as, for example, mastery of anticipating certain pitches based on pitch counts. These batting skills must continue to evolve for a batter as the level of pitching quality increases. In the professional arena, for example, pitch speeds can reach upwards of 90 to 100 mph and ball movement relative to the plate can sometimes be measured in terms of feet. With such pitching, mastery of batting skills is essential for success at the professional level.

Of all the batting skills, proper stride is crucial to proper form and execution during the swing. Proper positioning, weight shift, foot position and hip movement all follow in suit from an initial proper stride. While opinions vary as to the best way to stride when hitting a baseball, certain fundamentals are common amongst the greatest hitters in the game. These fundamentals require: a stride that is parallel to the path of the pitch and toward the pitcher's mound; a forceful forward stride to effect a proper weight shift from the batter's trailing (back) foot to the leading (front) foot; a leading foot that remains perpendicular to the path of the pitch so that it does not pivot toward the pitcher's mound, which causes the batter's knee and hip to improperly "open up" to face the pitcher; and a controlled stride width that is consistent with a particular player's build, so that the player does not over stride and lose power.

One way to engrain some of these fundamentals is through the use of training aids and devices. The goal of such devices is to develop one or more of these fundamentals so that they become second nature to the baseball player, which ultimately allows the player to focus less on swing mechanics and more on execution and the strategic aspects of batting.

While many such devices have been developed over the years, most such devices rely upon "positive" feedback in the form of outside physical or tactile stimuli, such as a resistance provided by a portion of the device. A problem with positive feedback in this form is that a player will not feel this feedback during game conditions. This can have a negative psychological effect on the reinforcement aspects of training with the device. This can also have an adverse affect on proprioceptive feedback. Furthermore, many of these devices are restrictive and cannot be used in "real time," i.e., during real or simulated full-speed pitching sessions. If used in full-speed situations, many of these devices pose great risk of injury to the player.

The present invention addresses these shortcomings, and provides other benefits as well, which will be readily apparent from the drawings, written description and claims herein.

SUMMARY OF THE INVENTION

An apparatus and associated method is provided for training a batter to hit a baseball with proper swing mechanics by controlling swing stride through tactile and proprioceptive feedback. The apparatus includes a base positionable on a ground surface adjacent to a hitting area and posterior to the batter standing on the ground surface. A stride limiter is adjustably attached to the base and transversely extends toward the hitting area adjacent a leading foot of the batter. The base and the stride limiter define a stride boundary for the batter during a swing, such that a negative feedback is provided to the batter during the swing if the batter's leading foot exceeds the stride boundary and contacts the apparatus and a positive feedback is provided to the batter during the swing if the batter's leading foot stays within the stride boundary and does not contact the apparatus. The apparatus may be configured with two stride limiters such that it can be positioned on either side of the hitting area to accommodate both right and left handed batters.

Other aspects will become apparent and be more fully understood from the drawings, descriptions, and claims set forth herein.

DETAILED DESCRIPTION OF PREFERRED EMBODIMENTS

Figure 1:
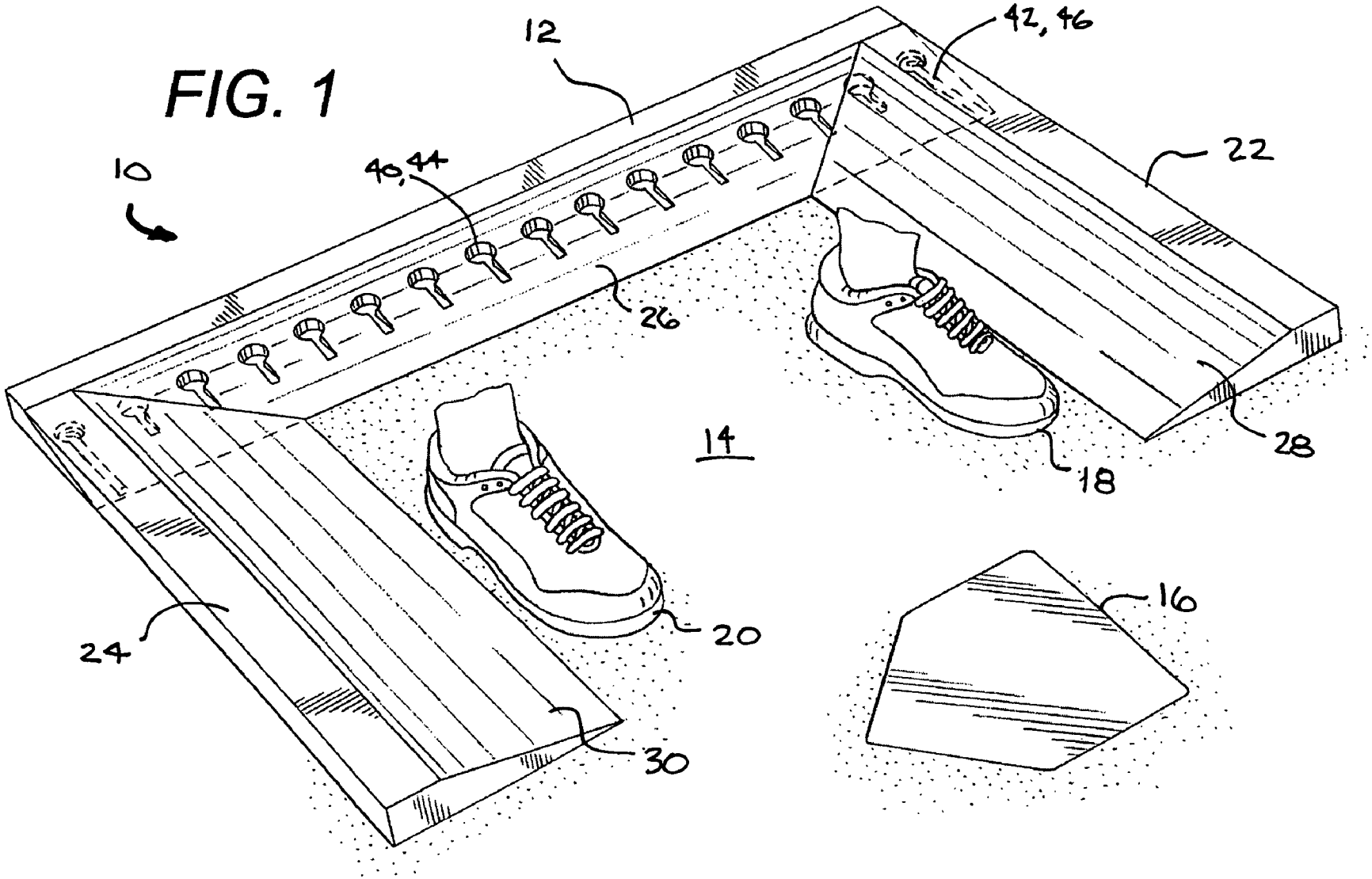
FIG. 1 is a perspective view of an apparatus in accordance with the principles of the present invention, the view including an illustration of a pair of feet of a player utilizing the apparatus in relation to a hitting area generally marked by a home plate.

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but other embodiments that may come to mind in accordance with these principles. The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may, but not always, be labeled with differing numbers in cases where such labeling may facilitate a more clear description. Additionally, the drawings set forth herein are not necessarily drawn to scale, and in some instances proportions may have been exaggerated to more clearly depict certain features.

The present invention is directed to an apparatus and associated method for training a batter to hit a baseball with proper swing mechanics by controlling swing stride through tactile and proprioceptive feedback. As shown in FIG. 1, an apparatus 10 in accordance with the principles of the present invention generally includes a base 12 positionable on a ground surface 14 adjacent to a hitting area generally marked by a home plate 16 and posterior to a batter's feet 18, 20 standing on the ground surface 14. A pair of stride limiters 22, 24 are adjustably attached to the base 12 and transversely extend toward the hitting area. In alternate embodiments, the apparatus 10 can be configured with only stride limiter 22 for right-handed batters and only stride limiter 24 for left-handed batters. In a preferred embodiment, however, both stride limiters 22, 24 are included in the apparatus 10 such that it can be positioned on either side of the hitting area to accommodate both right and left handed batters. For a right-handed batter, the stride limiter 22 is considered a leading stride limiter and the stride limiter 24 is considered a trailing stride limiter, and vice versa for a left-handed batter.

The base 12 preferably includes a sloped surface 26 that slopes toward the batter to prevent injury to the batter if the leading foot contacts the stride limiter during the swing. Likewise, the stride limiter 22 includes a sloped surface 28 and the stride limiter 24 includes a sloped surface 30. The apparatus 10 preferably is constructed of a heavy-weight rubber material, such as that typically used for home plates. The heavy weight provides stability to the apparatus 10 during use. In alternate embodiments, the apparatus 10 can be constructed from other materials, such as heavy-weight elastomeric or resilient polymers or composite materials. The apparatus 10 can also take the form of multi-material or layered configurations, such as a metal or hard polymeric base material coated with a resilient polymeric material or natural rubber.

Figure 2:
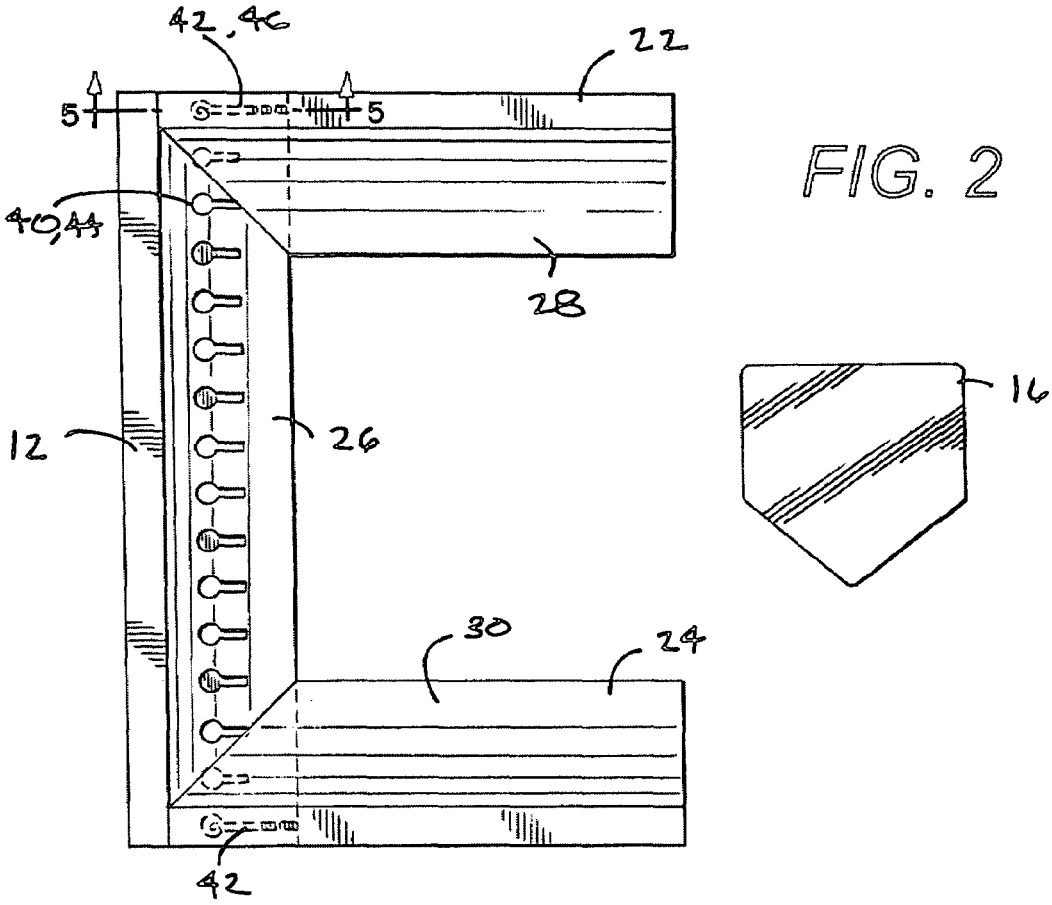
FIG. 2 is a top plan view of the apparatus of FIG. 1 shown in a fully-extended stride boundary position.
Figure 3:
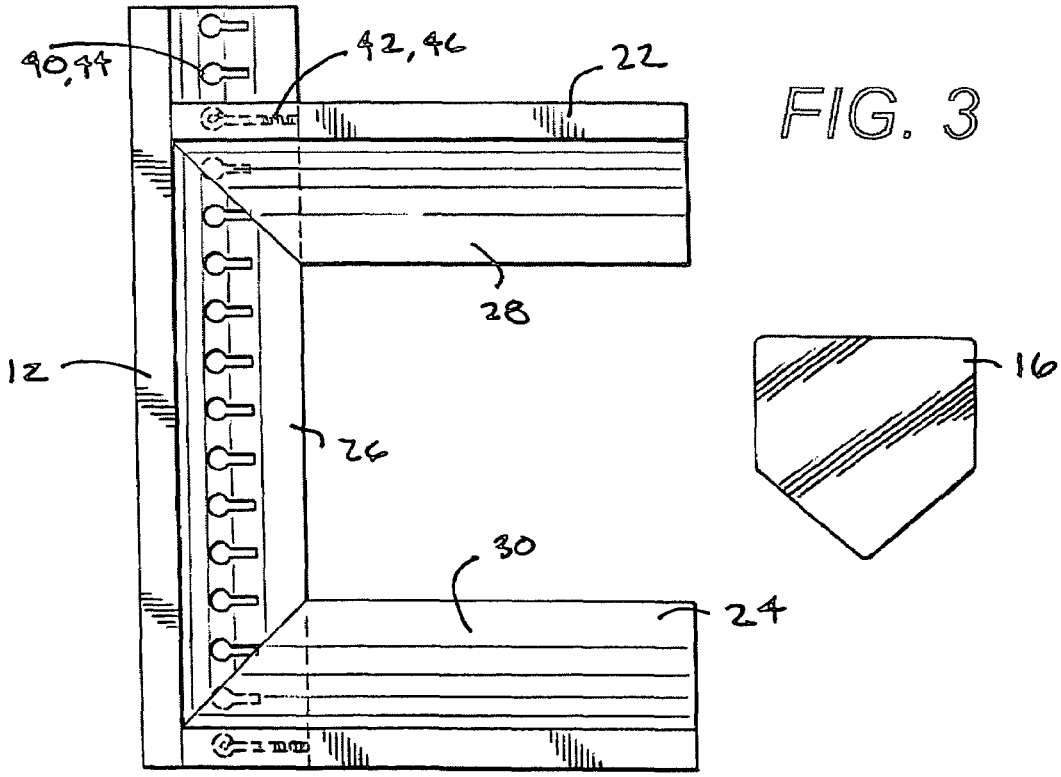
FIG. 3 is a top plan view of the apparatus of FIG. 1 shown in an adjusted stride boundary position.

As shown in FIGS. 2 and 3, the stride limiters 22, 24 can be adjusted with respect to the base 12 to accommodate various stride widths for players having differing builds and swing styles. The stride limiters 22, 24 should preferably be adjusted to match a particular player's optimal swing and stride pattern, which ensures that the player does not over stride and lose power. FIG. 2 illustrates the stride limiter 22 in a fully-extended position representing a maximum stride width of the apparatus 10. FIG. 3 illustrates the stride limiter 22 adjusted with respect to the base 12 to provide a more narrow stride width of the apparatus 10.

Figure 4:
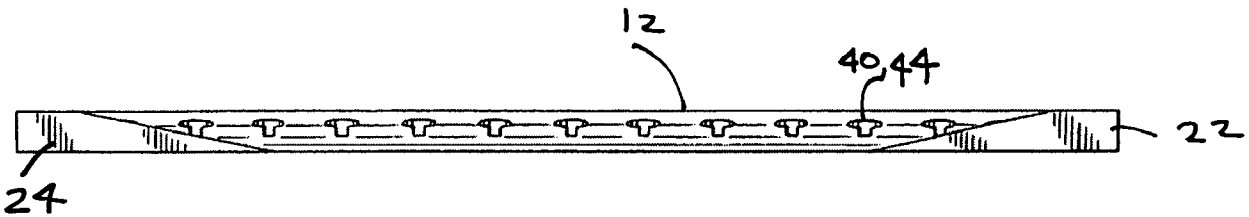
FIG. 4 is a front elevational view of the apparatus of FIG. 1.

Because a player's foot may make contact with the apparatus 10 during full-speed hitting situations, the apparatus 10 preferably has a low profile such as that illustrated in FIG. 4. The low profile, together with the sloped surfaces 26, 28, 30, aid in preventing injuries to a player during use of the apparatus 10 in full-speed pitch practice where the player's leading foot may make contact with one of the sloped surfaces 26, 28, 30.

Figure 5:
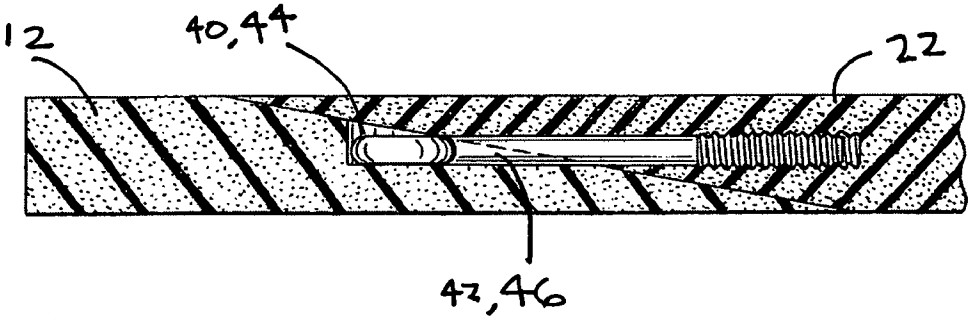
FIG. 5 is a partial cross-sectional view taken along section line 5-5 in FIG. 2.
Figure 6:
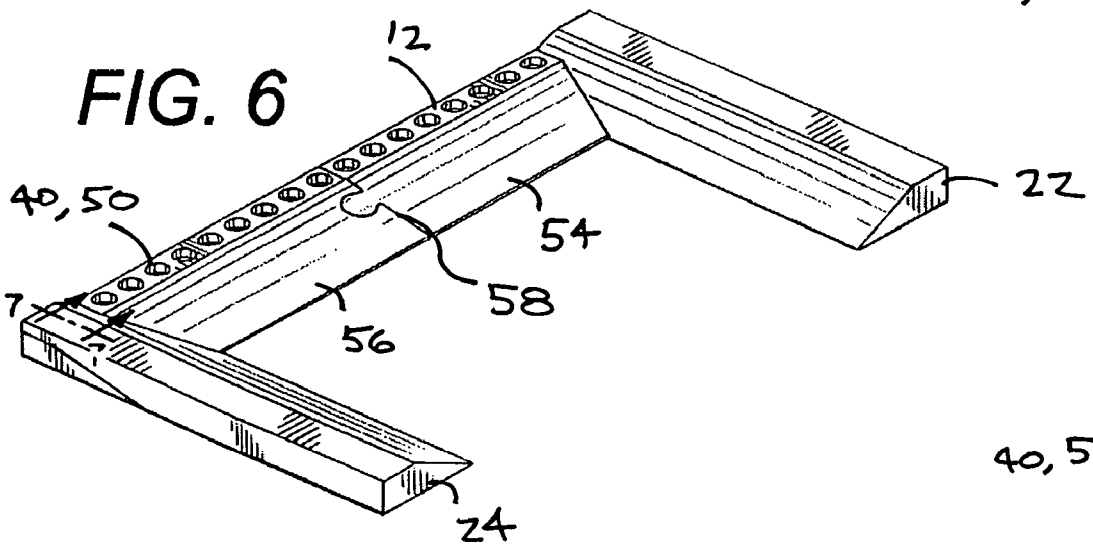
FIG. 6 is a perspective view of another embodiment of an apparatus in accordance with the principles of the present invention.
Figure 7:
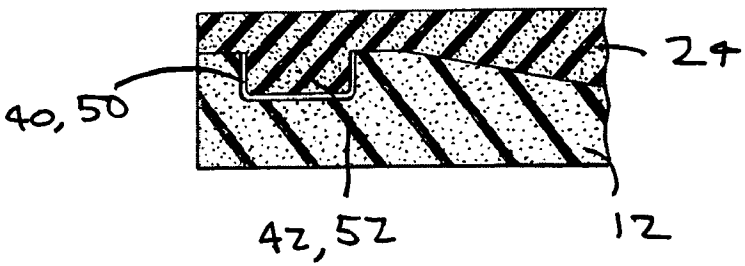
FIG. 7 is a partial cross-sectional view taken along section line 7-7 in FIG. 6.

As shown in FIGS. 2 and 5, the base 12 includes a plurality of adjustment features 40 and the stride limiters 22, 24 each include at least one corresponding adjustment feature 42 to facilitate adjustment of the stride limiters 22, 24 with respect to the base 12. Each of the adjustment features 40 of the base 12 is configured to engage the adjustment feature 42 of each of the stride limiters 22, 24. In one embodiment, as illustrated in FIGS. 2 and 5, each of the plurality of adjustment features 40 of the base 12 comprise a generally key-shaped receptacle 44. In the same embodiment, the adjustment features 42 of the stride limiters 22, 24 comprise a generally key-shaped protrusion 46 dimensioned to fit into the receptacle 44. In a preferred embodiment, the key-shaped protrusion 46 is in the form of a screw eye, or eye stud, as shown in FIG. 5. In an alternate embodiment as shown in FIGS. 6 and 7, the adjustment features 40, 42 respectively comprise a generally cylindrical-shaped receptacle 50 and a generally cylindrical-shaped protrusion 52 dimensioned to fit into the receptacle 50. In this embodiment, both adjustment features 40, 42 can be integrally molded or formed into the base 12 and the stride limiters 22, 24, respectively. In yet another alternative embodiment (not Shown), the protrusion 52 can be formed as part of the base 12 and the receptacle 50 can be formed as part of the stride limiters 22, 24.

In a preferred embodiment, as shown in FIG. 6, the base 12 comprises two base pieces 54, 56 that are removably attachable to each other at an attachment interface 58. The attachment interface can take the form of any number of attachment mechanisms, including, but not limited to, tongue-and-groove connection, protrusion-slot connection, protrusion-receptacle connection, hook-and-loop fastener connection, or the like. This two-piece configuration aids in transportability of the apparatus 10.

Figure 9:
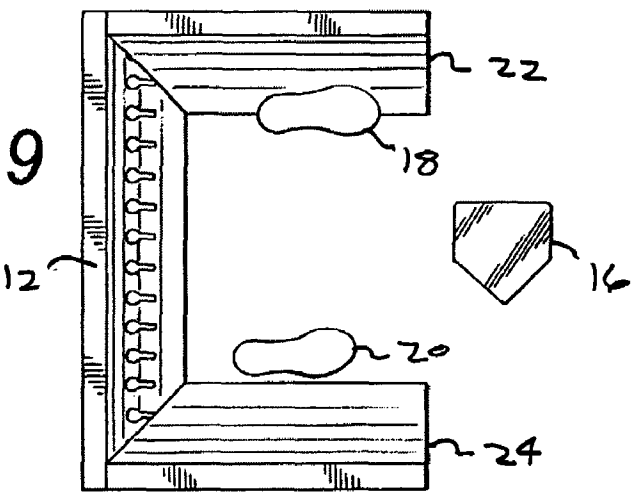
FIG. 9 is a top plan view of an apparatus in accordance with the principles of the present invention, the view including an illustration of an improper position of a pair of feet of a player utilizing the apparatus during a swing in relation to a hitting area generally marked by a home plate.
Figure 11:
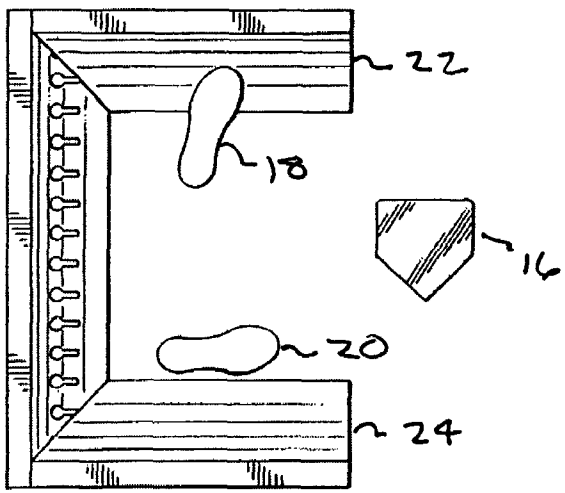
FIG. 11 is a top plan view of an apparatus in accordance with the principles of the present invention, the view including an illustration of an improper position of a pair of feet of a player utilizing the apparatus during a swing in relation to a hitting area generally marked by a home plate.
Figure 8:
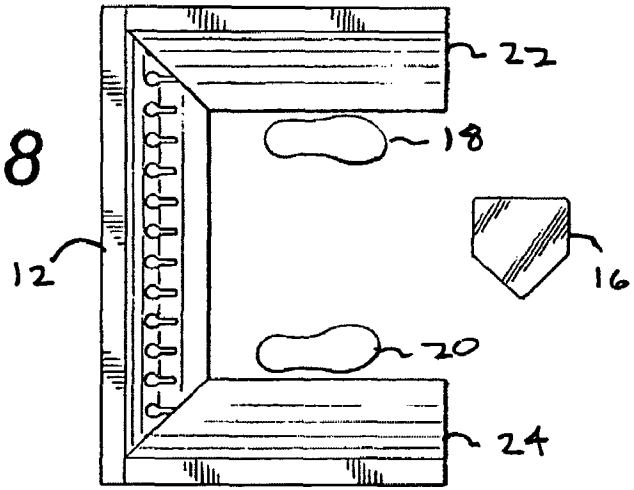
FIG. 8 is a top plan view of an apparatus in accordance with the principles of the present invention, the view including an illustration of a proper position of a pair of feet of a player utilizing the apparatus during a swing in relation to a hitting area generally marked by a home plate.
Figure 10:
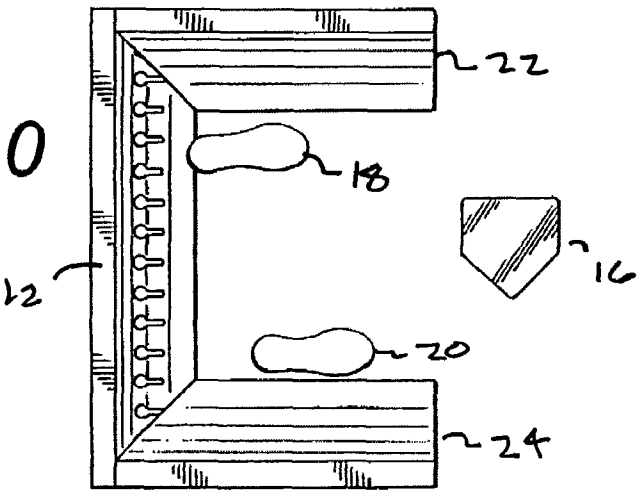
FIG. 10 is a top plan view of an apparatus in accordance with the principles of the present invention, the view including an illustration of an improper position of a pair of feet of a player utilizing the apparatus during a swing in relation to a hitting area generally marked by a home plate.

The base 12 and the appropriate leading stride limiter 22 or 24 (depending upon whether the apparatus 10 is set up for a right handed or left handed batter) define a stride boundary for the batter during a swing. A negative feedback is provided to the batter during the swing if the batter's leading foot exceeds the stride boundary and contacts the apparatus 10 and a positive feedback is provided to the batter during the swing if the batter's leading foot stays within the stride boundary and does not contact the apparatus 10. FIG. 8 illustrates a positive result wherein the batter stayed within the stride boundary during a swing. FIG. 9 illustrates a negative result wherein the batter exceeded the stride boundary with an excessive stride width during a swing. FIG. 10 illustrates a negative result wherein the batter exceeded the stride boundary by pulling his leading foot 18 back during the swing, thereby "opening up" his leading knee and hip. FIG. 11 illustrates yet another negative result wherein the batter exceeded the stride boundary by virtue of his leading foot 18 turning out toward the pitcher's mound.

An attractive feature of the apparatus (and related method) of the present invention is that it provides positive feedback in the form of a tactile response with the ground surface (i.e., when the batter does not make contact with the apparatus) and negative feedback in the form of a tactile response when the batter's foot does indeed contact the apparatus. This is in stark contrast to the majority of known stride training devices that rely upon contact with the apparatus for a positive response or for both a positive and negative response. Hence, the apparatus of the present invention does not become a distraction to the batter via contact with the apparatus during a proper or "positive" swing. Additionally, from a psychological standpoint, the apparatus has a positive reinforcement effect because the positive feedback during training will feel the same as the feedback during game conditions, i.e., the player will not make contact with the apparatus when making a proper swing. Thus, a batter will more easily translate this "non-contact" positive feedback received during training to game time situations.

Another benefit of this "non-contact" positive feedback is that it allows the batter to rely more upon proprioceptive feedback during the swing in an effort to avoid making contact with the apparatus. The batter can translate the stride width to "muscle memory" and rely upon proprioceptive feedback to maintain the proper stride during game time situations.

Yet another benefit of the "non-contact" positive feedback is that it allows for the use of a more simple and cost-effective apparatus compared to known stride training apparatus. The apparatus of the present invention does not require complex mechanisms or moving parts, nor does it require attachment to the batter. This results in a simple and low cost apparatus that can be implemented at all levels of the game.

A method for training a batter to hit a baseball in accordance with the principles of the present invention is also contemplated. In a preferred embodiment, the method comprises the steps of placing an apparatus on a ground surface adjacent to a hitting area and posterior to the batter standing on the ground surface, wherein the apparatus comprises an elongated base portion having a length and a stride limiter adjustably attached to the base portion and transversely extending toward the hitting area adjacent a leading foot of the batter; defining a stride boundary with the apparatus; providing a negative feedback to the batter during a swing if the batter's leading foot exceeds the stride boundary and contacts the apparatus; and providing a positive feedback to the batter during the swing if the batter's leading foot stays within the stride boundary and does not contact the apparatus.

While one or more specific embodiments have been illustrated and described in connection with the present invention, it is understood that the present invention should not be limited to any single embodiment, but rather construed in breadth and scope in accordance with recitation of the appended claims.

What is claimed is:

1. An apparatus for training a batter to hit a baseball with proper swing mechanics by controlling swing stride through tactile and proprioceptive feedback, the apparatus in combination with a home plate comprising:

a base positionable on a ground surface adjacent to a hitting area and posterior to the batter standing on the ground surface; and a stride limiter adjustably attached to the base portion and transversely extending toward the hitting area adjacent a leading foot of the batter;

the base and the stride limiter defining a stride boundary for the batter during a swing, the base and stride limiter providing a negative feedback to the batter during the swing if the batter's leading foot exceeds the stride boundary and contacts the apparatus, and providing a positive feedback to the batter during the swing if the batter's leading foot stays within the stride boundary and does not contact the apparatus wherein the stride limiter includes a sloped surface that slopes toward the batter to prevent injury to the batter if the leading foot contacts the stride limiter during the swing.

2. The apparatus of claim 1, wherein the base includes a sloped surface that slopes toward the batter to prevent injury to the batter if the leading foot contacts the base during the swing.

3. The apparatus of claim 1, further comprising a second stride limiter adjustably attached to the base portion and transversely extending toward the hitting area adjacent a trailing foot of the batter, thereby allowing the apparatus to be utilized by both right-handed and left-handed batters.

4. The apparatus of claim 1, wherein the base includes a plurality of adjustment features and the stride limiter includes at least one adjustment feature, each of the adjustment features of the base configured to engage the at least one adjustment feature of the stride limiter.

5. The apparatus of claim 4, wherein each of the plurality of adjustment features of the base comprise a receptacle and the adjustment feature of the stride limiter comprise a protrusion dimensioned to fit into the receptacle.

6. The apparatus of claim 5, wherein the receptacle and the protrusion are generally key-shaped.

7. The apparatus of claim 5, wherein the receptacle and the protrusion are cylindrically-shaped.

8. The apparatus of claim 1, wherein the base comprises two base pieces that are removably attachable to each other.

9. The apparatus of claim 1, wherein the base and the stride limiter are made of a rubber material.

10. An apparatus for training a batter to hit a baseball with proper swing mechanics by controlling swing stride through tactile and proprioceptive feedback, the apparatus in combination with a home plate comprising:

an elongated base having a length and positionable on a ground surface adjacent to a hitting area and posterior to the batter standing on the ground surface;

a leading stride limiter attached to the base portion and transversely extending toward the hitting area, the leading stride limiter adjustable along the length of the base so that it is positionable adjacent a leading foot of the batter; and a trailing stride limiter attached to the base portion and transversely extending toward the hitting area, the trailing stride limiter adjustable along the length of the base so that it is positionable adjacent a trailing foot of the batter;

the base and the leading stride limiter defining a stride boundary for the batter during a swing, the base and leading stride limiter providing a negative feedback to the batter during the swing if the batter's leading foot exceeds the stride boundary and contacts one or both of the base and the leading stride limiter, and providing a positive feedback to the batter during the swing if the batter's leading foot stays within the stride boundary and does not contact one or both of the base and the leading stride limiter wherein each of the stride limiters include a sloped surface that slopes toward the batter to prevent injury to the batter if the leading foot contacts the stride limiter during the swing.

11. The apparatus of claim 10, wherein the base includes a sloped surface that slopes toward the batter to prevent injury to the batter if the leading foot contacts the base during the swing.

12. The apparatus of claim 10, wherein the base includes a plurality of adjustment features and each stride limiter includes at least one adjustment feature, each of the adjustment features of the base configured to engage the adjustment features of the stride limiters.

13. The apparatus of claim 12, wherein each of the plurality of adjustment features of the base comprise a receptacle and each of the adjustment features of the stride limiters comprise a protrusion dimensioned to fit into the receptacle.

14. The apparatus of claim 13, wherein the receptacle and the protrusion are generally key-shaped.

15. The apparatus of claim 13, wherein the receptacle and the protrusion are cylindrically-shaped.

16. The apparatus of claim 10, wherein the base comprises two base pieces that are removably attachable to each other.

17. The apparatus of claim 10, wherein the apparatus is made from a rubber material.

18. A method for training a batter to hit a baseball with proper swing mechanics by controlling swing stride through tactile and proprioceptive feedback, the method utilizing the apparatus of claim 1 or claim 10 comprising the steps of:

placing an apparatus on a ground surface adjacent to a hitting area and posterior to the batter standing on the ground surface, the apparatus comprising an elongated base portion having a length and a stride limiter adjustably attached to the base portion and transversely extending toward the hitting area adjacent a leading foot of the batter;

defining a stride boundary with the apparatus;

providing a negative feedback to the batter during a swing if the batter's leading foot exceeds the stride boundary and contacts the apparatus; and providing a positive feedback to the batter during the swing if the batter's leading foot stays within the stride boundary and does not contact the apparatus.

* * * * *